US011613334B2

(12) United States Patent
Czernik

(10) Patent No.: US 11,613,334 B2
(45) Date of Patent: Mar. 28, 2023

(54) FIRST-STAGE DIVING REGULATOR

(71) Applicant: XDEEP Spółka z ograniczoną odpowiedzialnoscią, Góra (PL)

(72) Inventor: Piotr Czernik, Góra (PL)

(73) Assignee: XDEEP SPOLKA Z OGRANICZONA ODPOWIEDZIALNOSCIA, Gora (PL)

( * ) Notice: Subject to any disclaimer, the term of this patent is extended or adjusted under 35 U.S.C. 154(b) by 739 days.

(21) Appl. No.: 16/591,176

(22) Filed: Oct. 2, 2019

(65) Prior Publication Data

US 2020/0031442 A1 Jan. 30, 2020

Related U.S. Application Data

(63) Continuation of application No. PCT/IB2018/056490, filed on Aug. 27, 2018.

(30) Foreign Application Priority Data

Aug. 31, 2017 (PL) ..... 422714

(51) Int. Cl.
*B63C 11/22* (2006.01)

(52) U.S. Cl.
CPC ..... *B63C 11/2209* (2013.01)

(58) Field of Classification Search
CPC ..... B63C 11/00; B63C 11/02; B63C 11/18; B63C 11/22; B63C 11/2209; B63C 11/2236; B63C 2011/2218; B63C 2011/2254
See application file for complete search history.

(56) References Cited

U.S. PATENT DOCUMENTS

| | | | | |
|---|---|---|---|---|
| 3,179,118 | A | 4/1965 | Mitchell et al. | |
| 3,799,189 | A | 3/1974 | Christianson | |
| 4,015,630 | A | 4/1977 | Contreras | |
| 4,219,017 | A * | 8/1980 | Shamlian | B63C 11/2227 128/205.24 |
| 4,396,032 | A | 8/1983 | Duchesne et al. | |
| 5,176,169 | A | 1/1993 | Ferguson | |
| 5,379,761 | A | 1/1995 | Schuler | |
| 2013/0228240 | A1 * | 9/2013 | Noceti | F16K 5/08 137/505.39 |

FOREIGN PATENT DOCUMENTS

| | | | |
|---|---|---|---|
| EP | 3 838 392 | A1 | 4/1998 |
| EP | 2 489 587 | A3 | 8/2012 |
| EP | 2 636 429 | B1 | 12/2014 |
| JP | 2000-255489 | A | 9/2000 |

OTHER PUBLICATIONS

International Search Report issued by the International Searching Authority for corresponding International Patent Application No. PCT/IB2018/056490, dated Dec. 3, 2018.

* cited by examiner

*Primary Examiner* — Colin W Stuart
(74) *Attorney, Agent, or Firm* — Myers Wolin, LLC

(57) ABSTRACT

A first-stage diving regulator including the profiled body, swivel turret and the cylinder connector, whereas the axis of rotation of the swivel turret is perpendicular to the body axis, thus enabling by preferable arrangement of low pressure LP ports and high pressure HP ports of the body, and preferable arrangement of low pressure LP ports in the swivel turret and proper hose configuration at any possible equipment configuration by using the same first-stage regulator.

4 Claims, 11 Drawing Sheets

FIRST-STAGE DIVING REGULATOR

CROSS REFERENCE TO RELATED APPLICATIONS

This application is a continuation under 35 U.S.C. § 120 of International Application PCT/IB2018/056490, filed Aug. 27, 2018, which claims priority to Polish Application No. P.422714, filed Aug. 31, 2017, the contents of each are incorporated by reference herein.

FIELD OF THE INVENTION

A first stage diving regulator with separated stages allowing a proper hose configuration at any possible equipment configuration by using the same first stage. Thus, the device according to the solution is a gas pressure reducer mounted on scuba tanks (cylinders).

BACKGROUND

Breathing apparatuses are one of the fundamental items of diving equipment. Two-stage diving regulators consist of two components in which the initial pressure is reduced in two successive reduction stages. The first-stage regulator is screwed directly on the diving cylinder and reduces High Pressure (HP) to a fixed overpressure with respect to the ambient pressure called Low Pressure (LP). The second stage regulator reduces LP to the ambient pressure and is placed directly on the diving mouthpiece. The first-stage diving regulator is equipped with a high pressure (HP) port and low pressure (LP) port.

One of criteria to choose a first-stage regulator by divers is the number and arrangement of ports (outlets) enabling optimal hose arrangement and location depending on the equipment configuration used for: recreational diving, technical diving, sidemount diving, the use of a single cylinder, a double cylinder (Twinset) or a stage bottle. Number of necessary ports of the first-stage diving regulator is determined by the equipment configuration used. A submersible pressure gauge or a gauge console is connected to HP ports, while to LP ports, beside the second-stage regulator, such accessories as an alternate second stage diving regulator that reduces pressure directly at the mouthpiece, a BCD inflator (buoyancy compensator) and a drysuit inflator can be connected. Such large amount of equipment hinders optimal hose arrangement, increases the risk of hose entanglement and forces bending at small angles, thus causing damage to hose core, and, as a consequence, to gas losses. If such situation arises when diving, it is extremely dangerous and may lead to injuries or death by drowning. Properly arranged hoses do not limit freedom of diver movements and are arranged smoothly without impeding access to valves. In optimal arrangement the hoses leave the first stage of the regulator in a direction where they are to be laid without bending by other diver equipment such as cylinders, and especially, the buoyancy compensator.

To meet the above requirements, instead of conventional designs with ports located around the regulator body that in the vast majority of cases prevents hoses to be ideally arranged, and first-stage regulators with a specific LP and HP port arrangements or first stages with swivel turrets are more and more often used. First-stage diving regulators with a specific LP and HP port arrangement meet the criteria of a proper hose leading out in a direction where they are to be laid but are dedicated to a specified equipment configuration. The first-stage regulators with swivel turrets have ports oriented perpendicular (at an angle of 90°) to the axis of rotation or turret axis, thus facilitating hose arrangement but forcing horizontal position of the regulator but impeding access to valves and leaving less space for the head of a diver, especially when a twinset is used.

The first-stage diving regulator according to the solution eliminates these problems and inconveniences.

The solution can be used in all configurations of diving equipment allowing, by using the same first-stage diving regulator, a proper hose arrangement to be reached in all known equipment configurations, a HP ports orientation towards the bottom part of the cylinder regardless of the regulator position, and an optimal orientation arrangement of LP hoses by using a swivel turret.

A design of two-stage diving regulators is known from patent description No. U.S. Pat. No. 3,179,118, where in the first-stage diving regulator the inner valve is placed in the axis of a cylinder connector, and the LP hose for the second stage is connected to a port in the unit body and routed perpendicularly to the body.

There is known a design of a first-stage regular from patent description No. U.S. Pat. No. 3,799,189, in which the inner valve is placed transversely to the cylinder connector axis, while the LP hose for the second stage is connected to the port arranged in the axis of the inner valve and routed perpendicularly to the body.

There is known a design of the first-stage regulator with two LP ports from patent description No. U.S. Pat. No. 4,015,630, where the second port allows a stab jacket (Buoyancy Control Device) to be directly connected and both LP ports are set at an angle to the axis of the regulator body and inner valve.

A number of patent descriptions, including U.S. Pat. Nos. 4,396,032, 5,176,169, 5,379,761 and JP 2000255489, disclose designs in which the first-stage diving regulators are fitted with swivel turrets, where the turret always rotates around the axis of the inner valve and the body, while LP ports are arranged perpendicularly or at an angle to the body axis and the axis of rotation of the regulator turret.

SUMMARY

The first-stage regulator according to the solution comprises a profiled body, a swivel turret and a cylinder connector. The swivel turret is located in the bottom part of the body and its axis of rotation is perpendicular to the body axis. The cylinder connector is located in the upper part of the body and its axis is perpendicular to the body axis. The axis of cylinder connector and the axis of rotation of the turret are parallel to each other and lay in the same plane that, preferably, is also the plane of symmetry of the body.

Inside the body along its axis there is a set of valves and diaphragms, and preferably, antifreeze protection of the water chamber with an anti-freeze unit.

Preferably, the profiled body is fitted in its front part with LP (low pressure) ports and HP (high pressure) ports. Preferably, HP and LP body ports are arranged at an angle to the plane of symmetry of the body. Preferably, HP ports are tilted towards the upper part of the body and the cylinder connector. Preferably, HP ports are tilted towards the bottom part of the body and the body turret. The outlets of LP and HP body ports are profiled to facilitate hose connection that in combination with arrangement and orientation of HP and LP ports allows the optimal arrangement of the HP and LP hoses coming out from the ports and proper hose laying.

Preferably, the profiled body in its bottom part is fitted with a seat of the swivel turret. The seat of the swivel turret is adjusted to the shape of the swivel turret, and the axis of rotation of the turret is perpendicular to the body axis. The swivel turret has a cylindrical shape and is connected to the body by the base of the turret. Preferably, on the turret circumference in the front part of the turret LP ports are arranged and in the rear part of the turret and notches of the positioning screw that set position of the turret.

The swivel turret can rotate freely around its axis, and be locked into a position with the turret positioning screw. The positioning screw is screwed into the body and enables rotation of the swivel turret in one or several selected positions. If the positioning screw is entirely unscrewed, it is possible to change position of the swivel turret during scuba diving. Preferably, LP ports are arranged at an angle to the turret base. The outlets of LP and HP ports of the turret are profiled to facilitate hose connection that in combination with arrangement and orientation of HP and LP ports allows the optimal arrangement of the HP and LP hoses coming out from the ports and proper hose laying.

Preferably, the profiled body in its bottom part is fitted with the seat of swivel turret. The seat of cylinder connector is adjusted to the shape of cylinder connector and the cylinder connector axis is perpendicular to the body axis, thus LP and HP ports are always oriented downwards with respect to the dive cylinder, regardless of regulator position.

Preferably, the axis of rotation of the turret is perpendicular to the axis of inner valve, thus improving gas flow inside the first stage, increasing the maximum gas flow rate.

The solution according to this solution by using a swivel turret, where the axis of rotation is perpendicular to the body axis, and preferably, arrangement of LP turret ports and, preferably, arrangement of LP ports in the front part of the body, allows correct LP hose routing at any possible equipment configurations by using the same first-stage regulator.

The solution according to this application, by placing the cylinder connector with the axis of its rotation perpendicular to the body axis, and preferably, arrangement of HP ports in the front part of the body, and preferably, arrangement of HP ports always towards the bottom part of the cylinder, regardless of the regulator position, allows correct HP hose configuration at any possible equipment configurations by using the same first-stage regulator.

BRIEF DESCRIPTION OF THE DRAWINGS

The object of the solution is presented in the embodiment of the first-stage diving regulator, where.

DETAILED DESCRIPTION OF THE PREFERRED EMBODIMENTS

Figure 1:
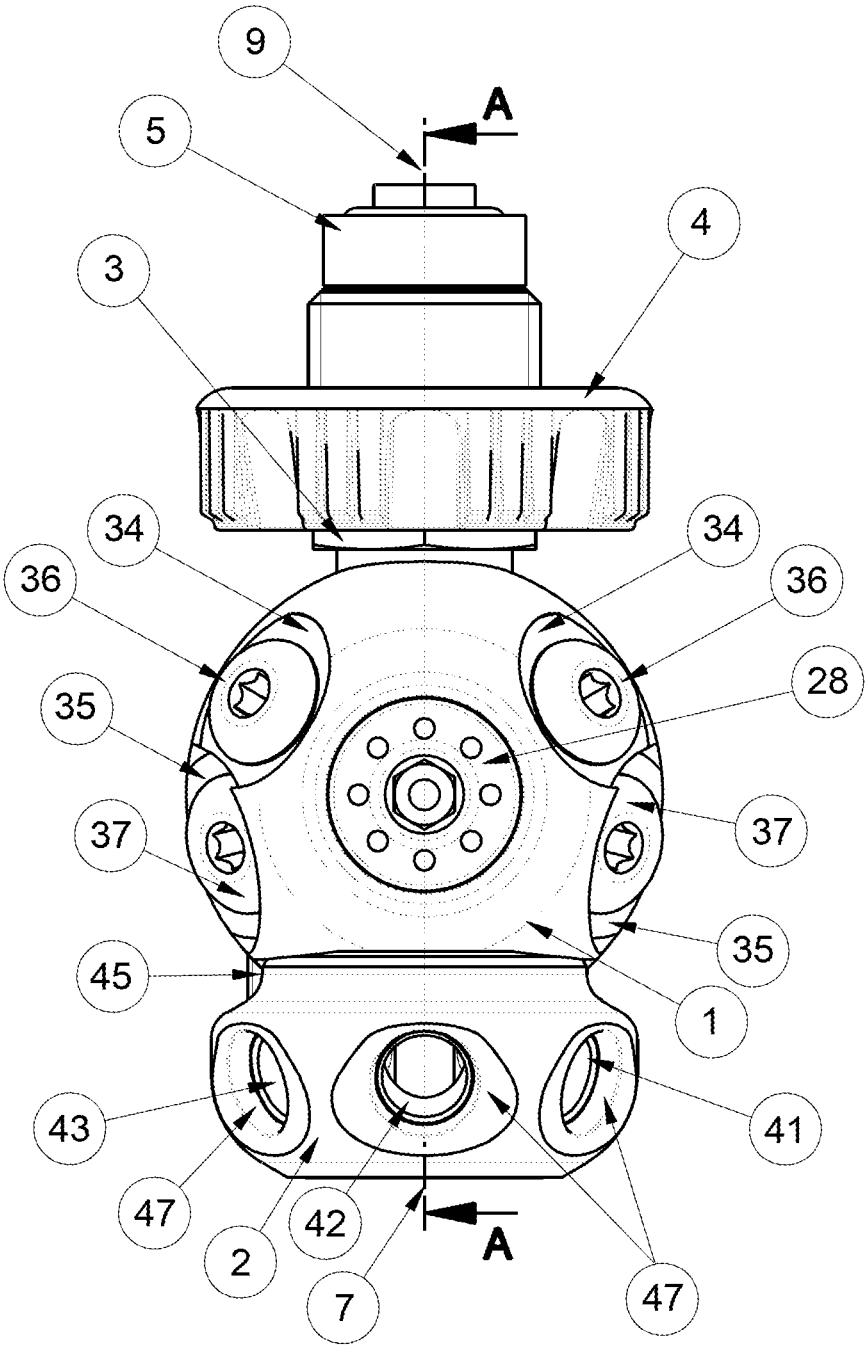
FIG. 1 shows a main view of the first-stage diving regulator from the front of the body and the front of the swivel turret.
Figure 2:
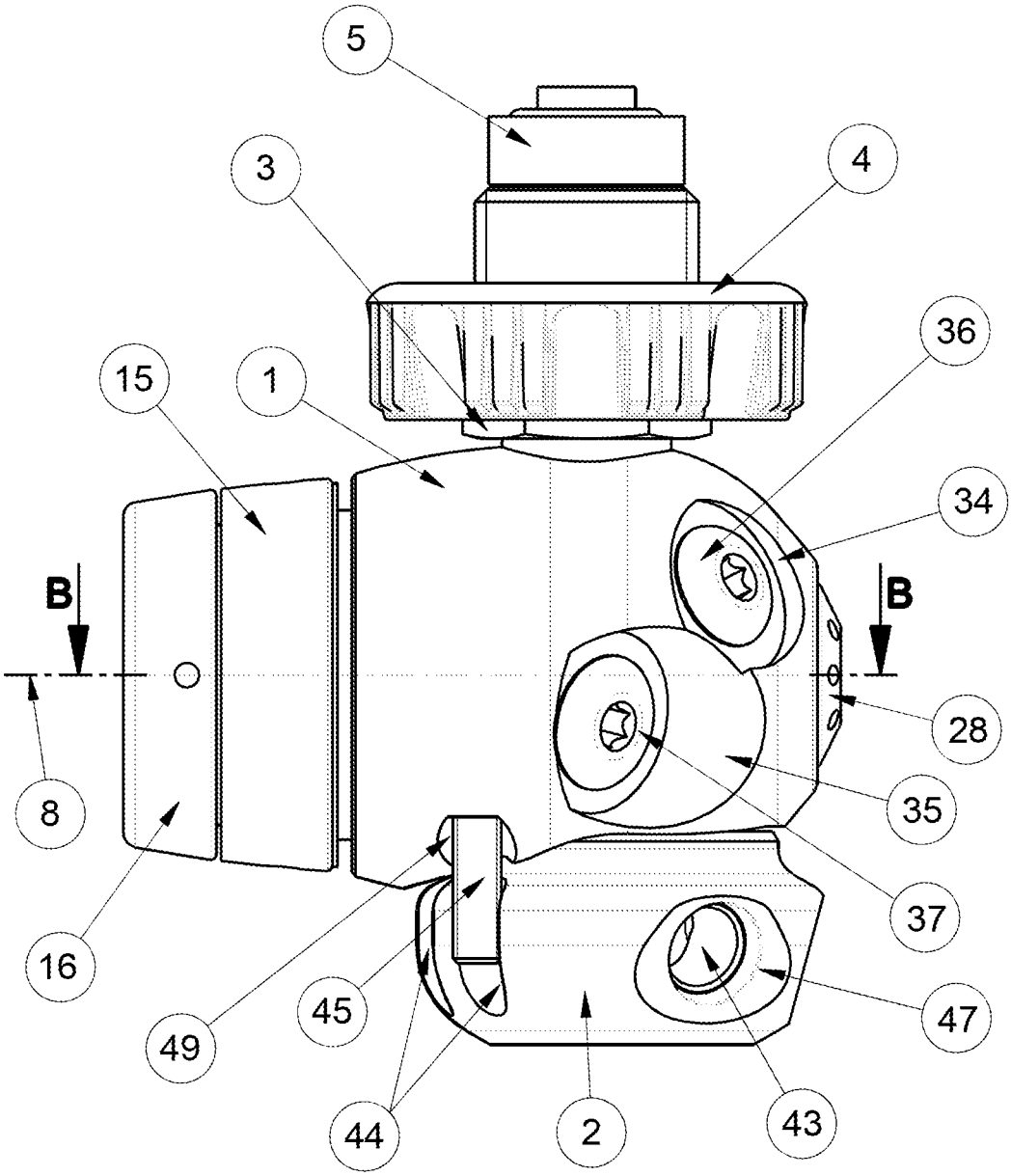
FIG. 2 shows a side view of the first-stage diving regulator.
Figure 3:
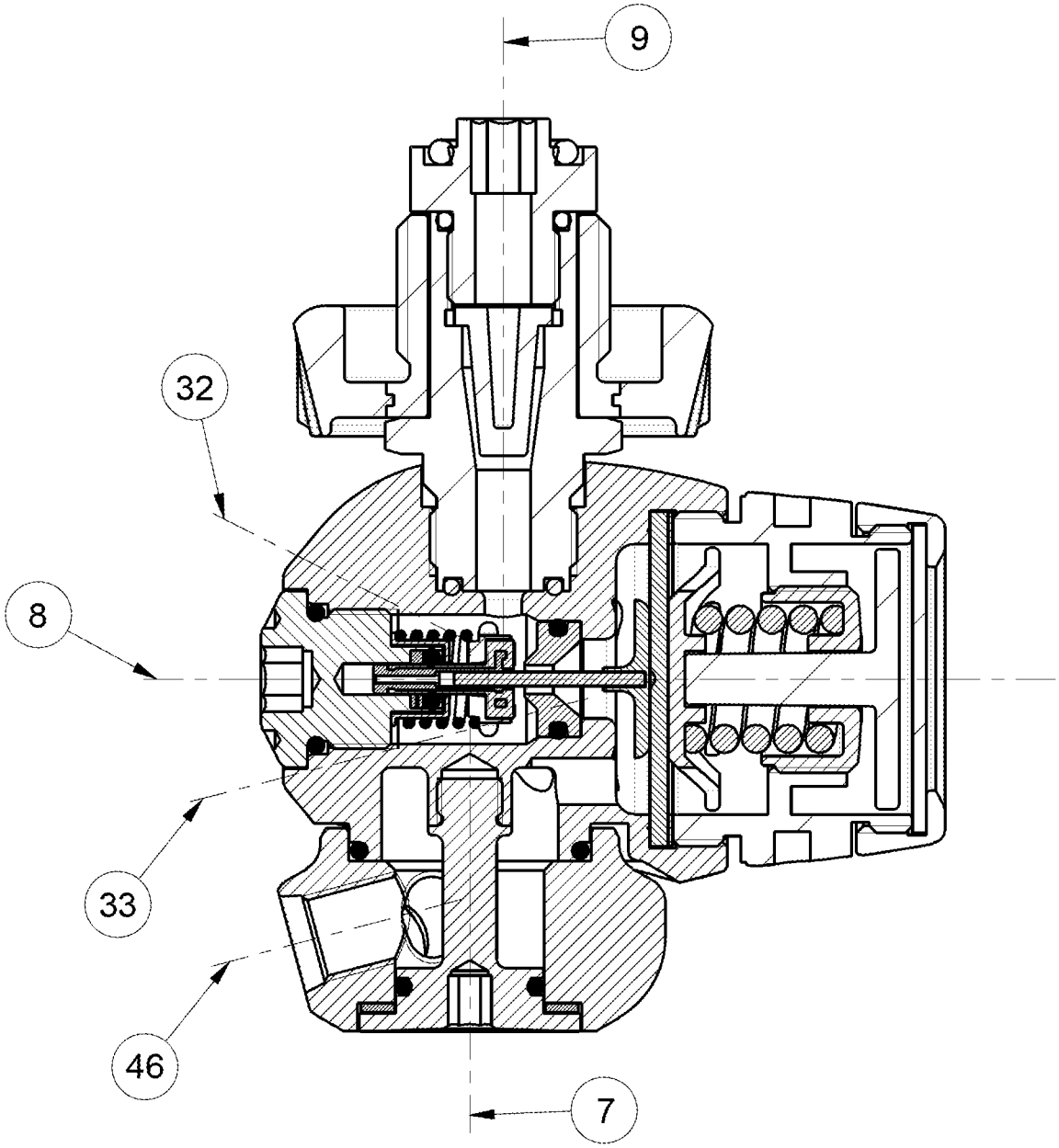
FIG. 3 shows a cross section along line A-A in FIG. 1 of the first-stage diving regulator, a cross section in the plane of symmetry of the body.
Figure 4:
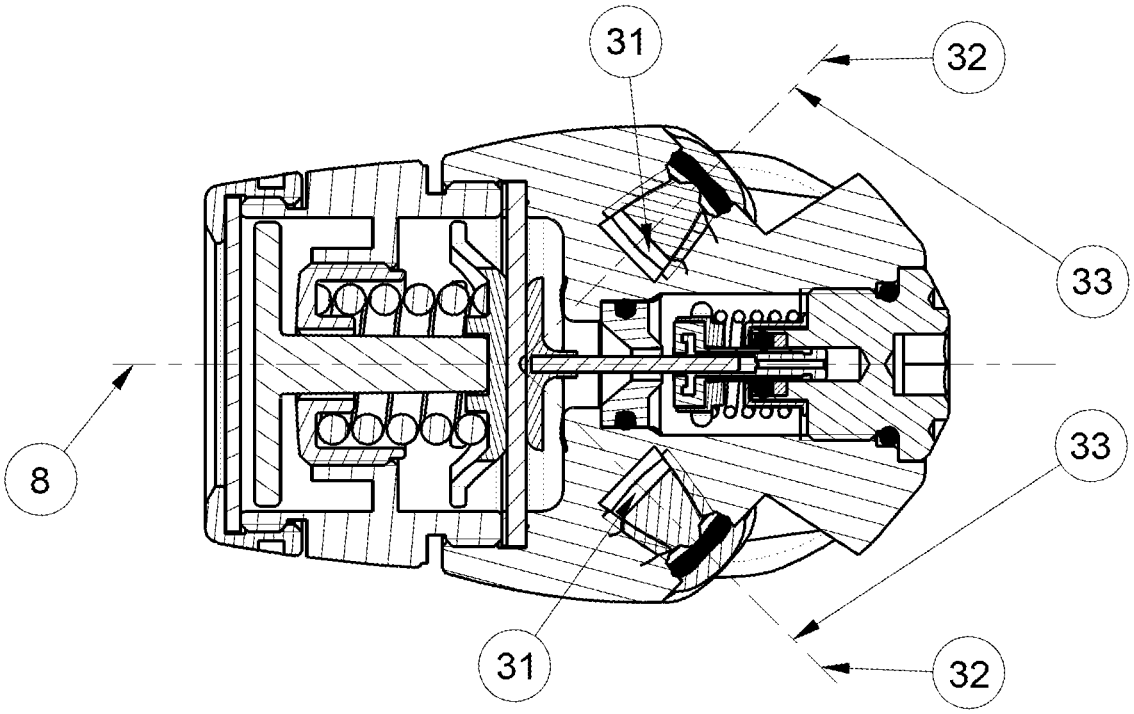
FIG. 4 shows a cross section along line B-B in FIG. 2 of the first stage diving regulator.
Figure 5:
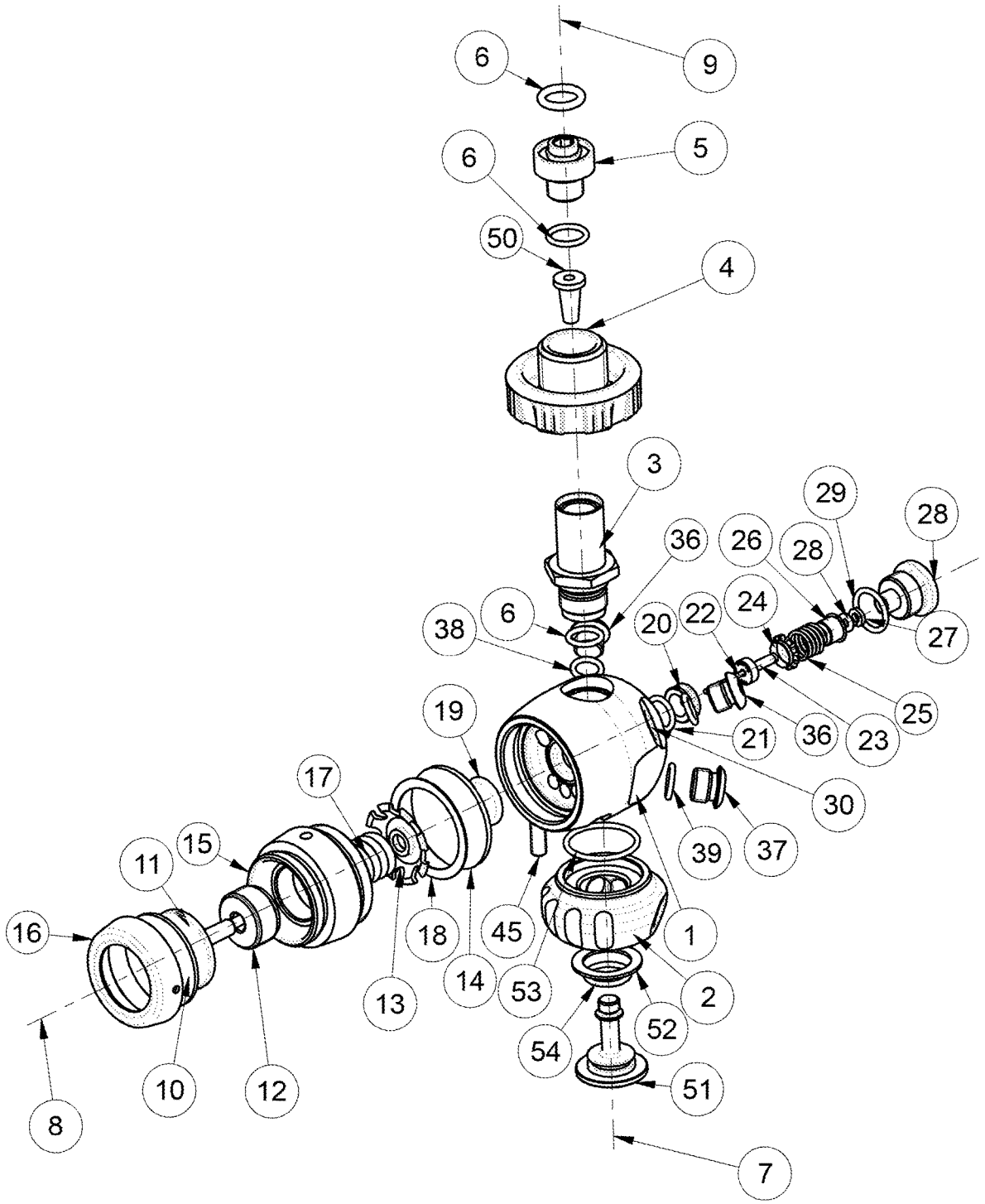
FIG. 5 shows an isometric assembly view of components of the first-stage diving regulator.
Figure 7:
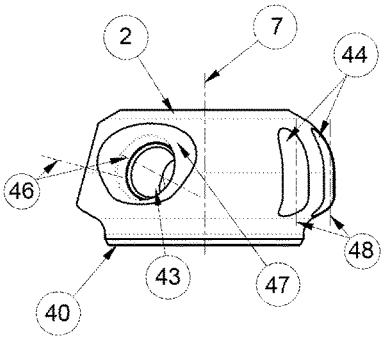
FIG. 7 shows a side view of the swivel turret of the first-stage diving regulator.
Figure 6:
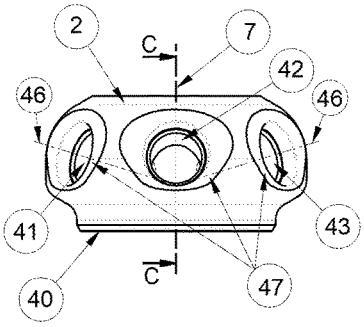
FIG. 6 shows a main view of the swivel turret of the first-stage diving regulator.
Figure 9:
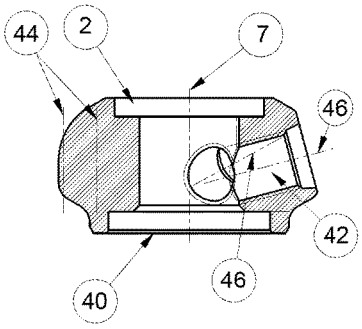
FIG. 9 shows a cross section along line C-C in FIG. 8 of the first stage diving regulator.
Figure 8:
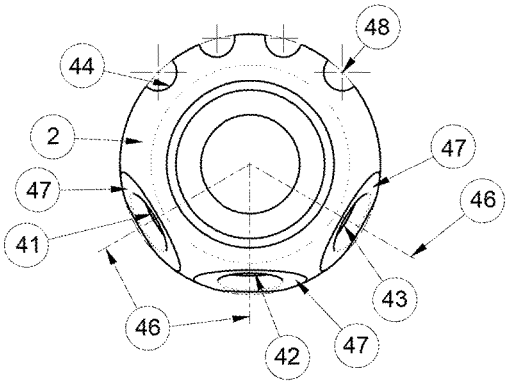
FIG. 8 shows a top view of the swivel turret of the first-stage diving regulator.
Figure 10:
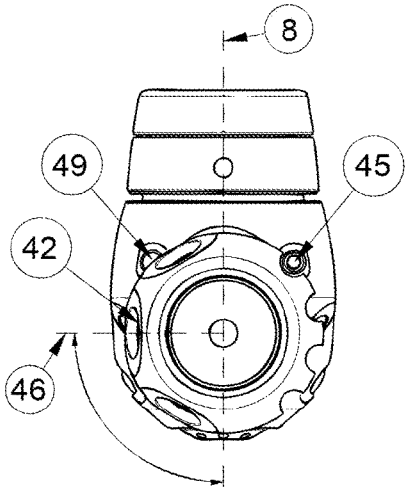
FIG. 10 shows a view of the properly mounted first-stage diving regulator with body ports oriented towards the cylinder bottom and the swivel turret in its extreme left position.
Figure 11:
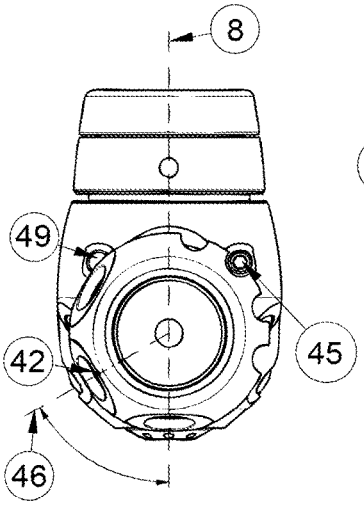
FIG. 11 shows a view of the properly mounted first-stage diving regulator with body ports oriented towards the cylinder bottom and the swivel turret in its second left position.
Figure 12:
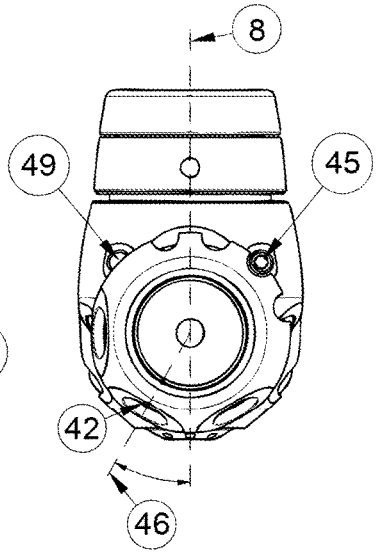
FIG. 12 shows a view of the properly mounted first-stage diving regulator with body ports oriented towards the cylinder bottom and the swivel turret in its first left position.
Figure 13:
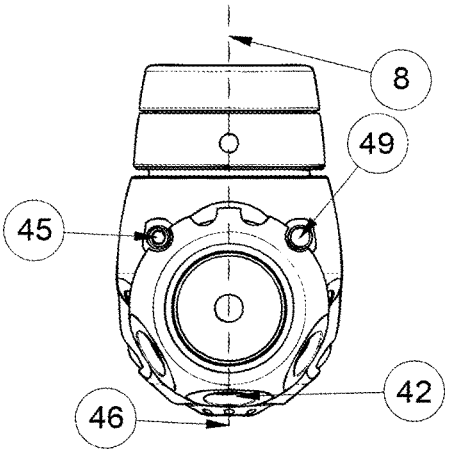
FIG. 13 shows a view of the properly mounted first-stage diving regulator with body ports oriented towards the cylinder bottom and the swivel turret in its neutral position.
Figure 14:
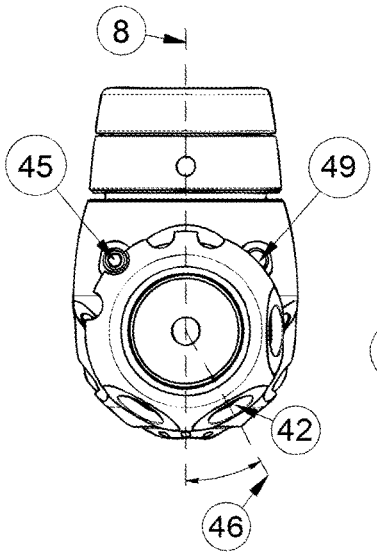
FIG. 14 shows a view of the properly mounted first-stage diving regulator with body ports oriented towards the cylinder bottom and the swivel turret in its first left position.
Figure 15:
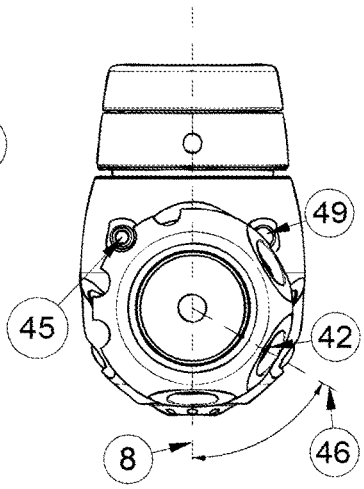
FIG. 15 shows a view of the properly mounted first-stage diving regulator with body ports oriented towards the cylinder bottom and the swivel turret in its second right position.
Figure 16:
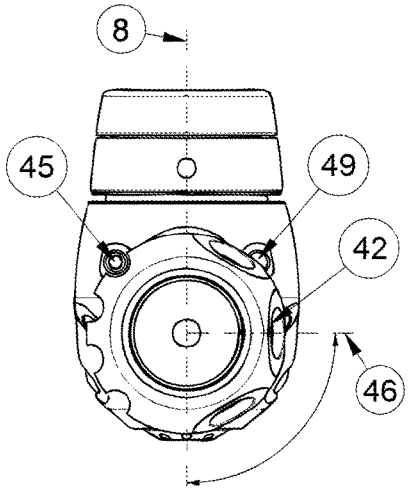
FIG. 16 shows a view of the properly mounted first-stage diving regulator with body ports oriented towards the cylinder bottom and the swivel turret in its extreme right position.
Figure 17:
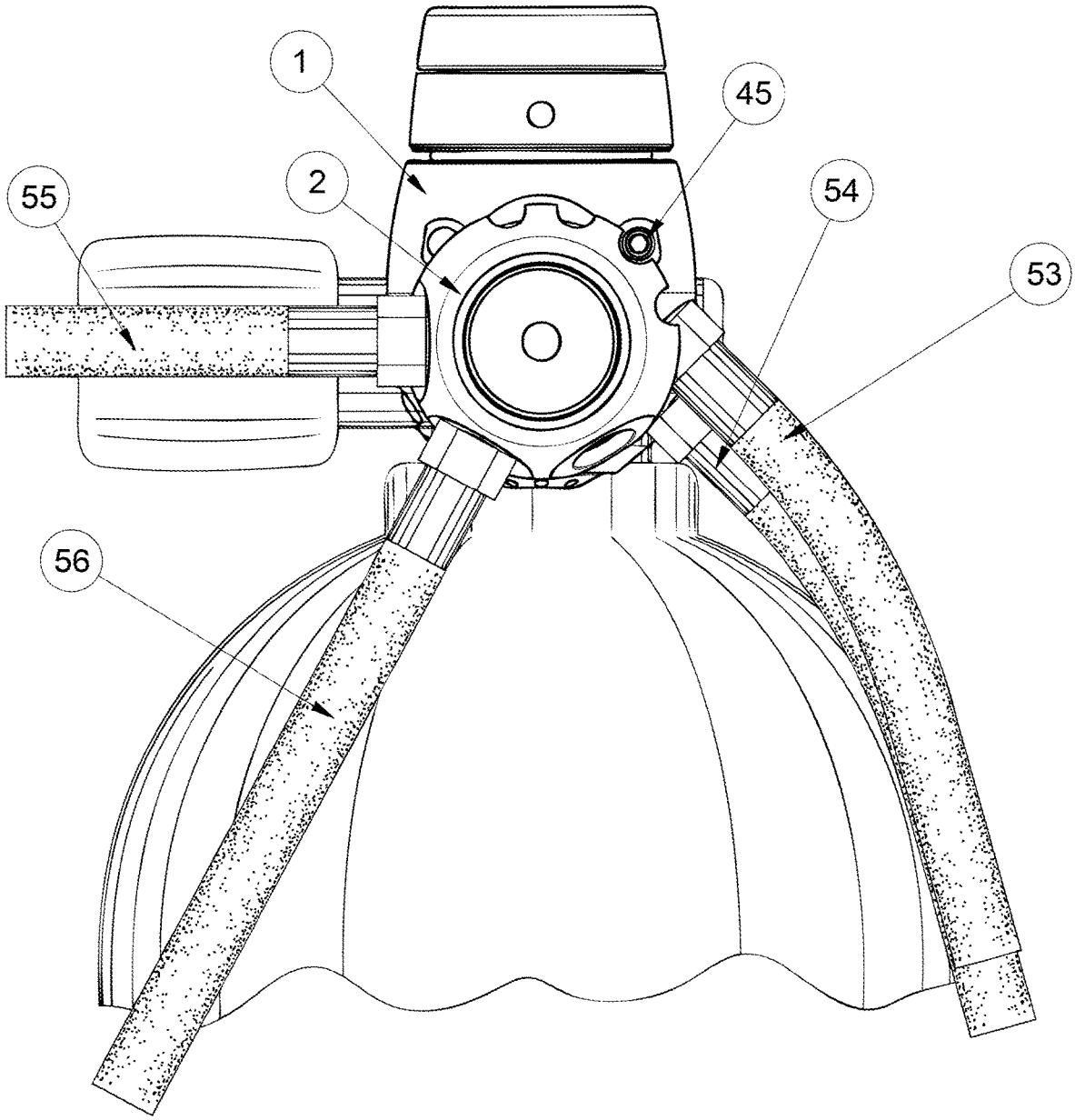
FIG. 17 shows the first-stage diving regulator attached to the dive cylinder in a single cylinder configuration.
Figure 18:
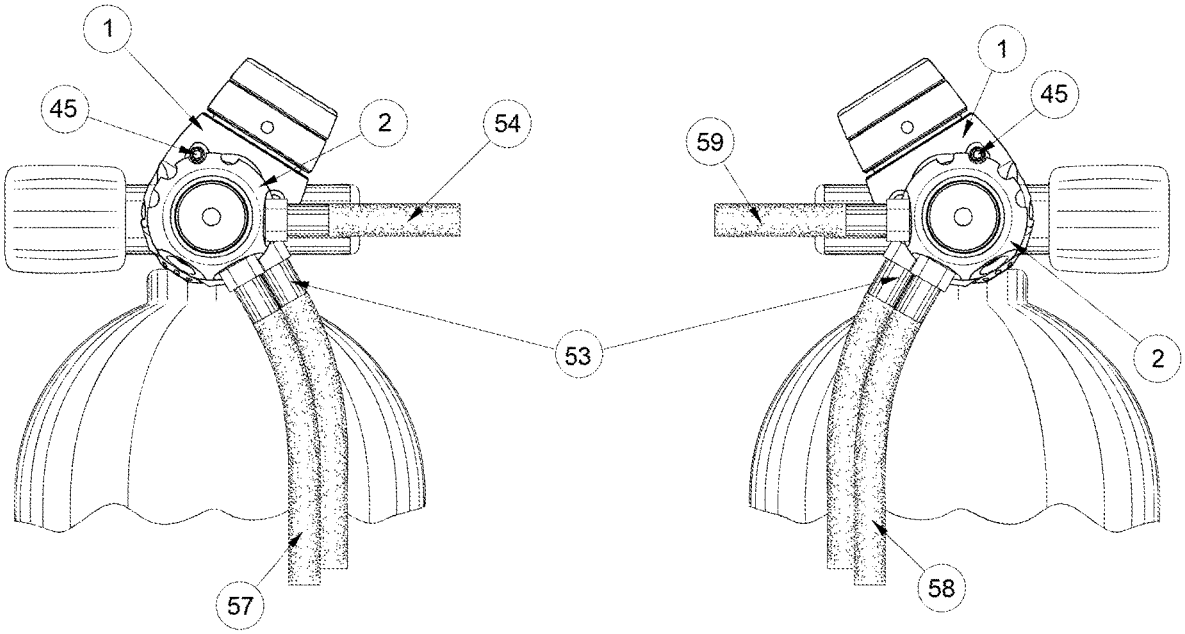
FIG. 18 shows the first-stage diving regulators attached to the dive cylinder in a side mount configuration with two independent cylinders.
Figure 19:
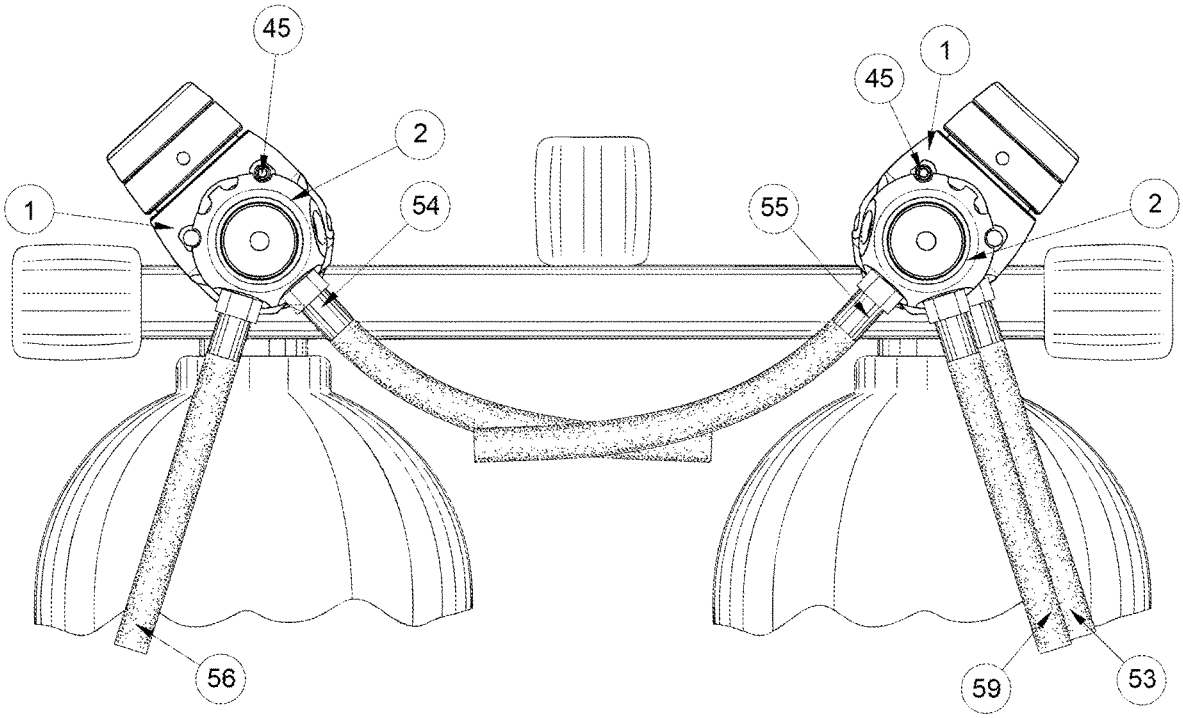
FIG. 19 shows the first-stage diving regulators attached to the dive cylinder in a double cylinder (twinset) configuration for technical diving.
Figure 20:
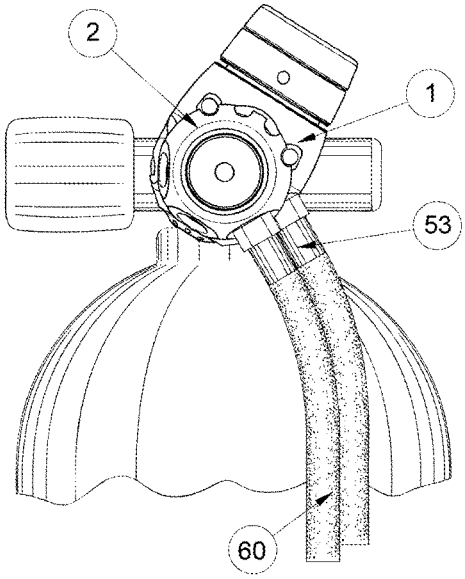
FIG. 20 shows the first-stage diving regulator with unused stage/decompression bottle in the idle position.
Figure 21:
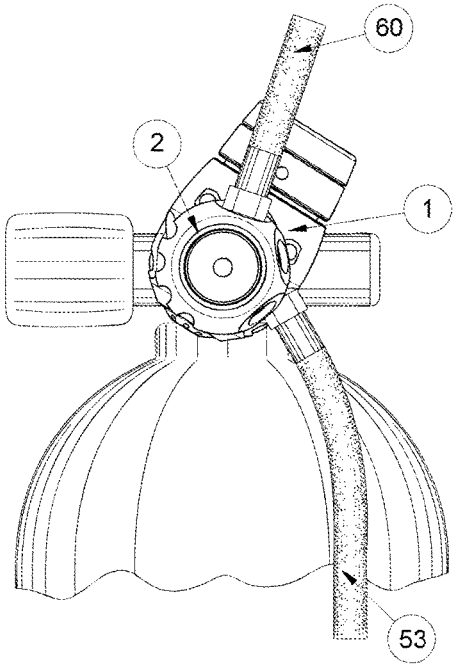
FIG. 21 shows the first-stage diving regulator with a stage/decompression bottle ready for use.

In the embodiment the first-stage diving regulator according to the solution comprises a profiled brass body (1) shaped like a cylinder with a semi-circular truncated dome of the brass swivel turret (2) and a cylinder connector.

The cylinder connector is equipped with a brass cylinder connector sleeve (3), a metal cylinder connector knob (4) coated with plastic or rubber for better adhesion, and a brass cylinder connector screw (5) DIN 300 bar. There is a cone filter (50) inside the cylinder connector sleeve (3) made of bronze. The connections of the screw (5) to the dive cylinder, the screw (5) to the cylinder connector (3) and the cylinder connector (3) to the body (1) are sealed with each other with plastic o-rings (6) of the cylinder connector.

The swivel turret (2) is located in the bottom part of the body (1) and its axis of rotation (7) is perpendicular to the body axis (8), The cylinder connector is located in the upper part of the body (1) and its axis (9) is perpendicular to the body axis (8). The axis (9) of the cylinder connector and the axis of rotation (7) of the turret are parallel to each other and lay in the plane of symmetry of the body.

Inside the body (1) along its axis (8) there is a set of valves and diaphragms, and antifreeze protection of the water chamber with an anti-freeze unit with so called dry water chamber. The antifreeze unit is equipped with a silicone anti-freezing membrane (10). The plastic pusher (11) of the anti-freeze unit enters the opening in the brass spring adjusting screw (12) and works with the spring retaining ring (13) and the membrane (14), both made of plastic.

The pusher (11) of the antifreeze unit is placed in the brass pusher seat (15) of the anti-freeze unit. All this is protected with a brass cover (16) of the anti-freeze unit. The set of valves and diaphragms is fitted with a stainless steel adjustment spring (17), supported on one side with the spring adjusting screw (12) and the spring retaining ring (13) on the other side, and a polyamide washer (18), a membrane (14) and a valve. The valve consists of a brass valve tie rod disk (19), a stainless steel valve seat (20) with o-ring (21) in which the stainless steel valve poppet (22) moves being pushed by the brass piston (23), a brass valve sealing sleeve guide (24), steel closing spring (25), a valve sealing sleeve (26) and a Teflon ring (27). The valve is protected against external influences with a valve plug (28) screwed directly into the body (1) and sealed with a plastic o-ring (29).

The profiled body (1) in its front part is equipped with two LP low pressure ports (30) with the UNF ⅜" thread, and two HP high pressure ports (31) with the UNF 7⁄16" thread.

The axes of LP ports (32) and axes of HP ports (33) of the body (1) are tilted 45° to the plane of symmetry of the body. The axes of LP ports (32) are tilted 25° to the body axis (8) towards the upper part of the body and the cylinder connector. The axes of HP ports (33) are tilted 15° to the body axis (8) towards a bottom part of the body and the body turret. At the outlets of LP ports (30) the body (1) has profiling (34), and at the outlets of HP ports (31) the body (1) has profiling (35) to facilitate hose connection. In the embodiment presented in figures, the LP ports (30) of the body (1) are blanked with brass plugs (36) with the UNF ⅜" thread and sealed with o-rings (38). In the embodiment presented in figures, the HP ports (31) of the body (1) are blanked with brass plugs (37) with the UNF 7⁄16" thread and sealed with o-rings (39).

The HP port (31) arrangement described above allows HP hoses to be routed always towards the bottom part of the cylinder, regardless of a regulator position, thus enabling proper HP hose configuration at any possible equipment configurations by using the same first-stage regulator.

The profiled body (1) in its bottom part is fitted with the seat of the swivel turret (2). The seat of the swivel turret of the body (1) is adjusted to the shape of the swivel turret (2), and the axis of rotation (7) of the turret is perpendicular to the body axis (8). The swivel turret (2) has a cylindrical shape and its base (40) joins to the body. The swivel turret (2) is attached to the body (1) with a brass swivel turret screw (51) and its rotation is enabled by a Teflon bearing pad (52).

The tightness at the junction between the body (1) and the swivel turret (2) is ensured by a plastic o-ring (54). The tightness at the junction between the swivel turret (2) and the turret screw (51) is ensured by a plastic o-ring (54).

There are three LP ports (41, 42, 43) of the turret arranged around the circumference of the swivel turret with the UNF ⅜" thread, and four notches (44) for the swivel turret positioning screw (45). In the embodiment presented in Figures the LP ports (41, 42, 43) of the swivel turret (2) the brass plugs were removed for clarity and better presentation of the essence of the solution.

The LH port (41) and RH port (43) are arranged symmetrically with respect to the central LP port (42) in the front part of the swivel turret (2). The angle between axes of LP ports (46) is 60°. LP ports (41, 42, 43) are arranged at an angle of 15% to the turret base plane. At outlets of LP ports (41, 42, 43) the swivel turret (2) has profiling (47) to facilitate hose connection.

The four notches (44) are distributed in the rear part of the turret. The axes of notches are on the circumference of the swivel turret (2). The angle between axes of notches (48) is 30°. The angle between the axes of extreme ports (41, 43) and the axes of nearest extreme notches (44) is 75°.

The turret positioning screw (45) can be screwed in one of two adjustment seats (49) of the body (1). The arrangement of four notches for the positioning screw (45) allows rotation of the turret to locked at 7 positions every 30 degrees.

In a neutral position of the swivel turret (2) the axis (46) of the central LP port (42) coincides with the body axis of symmetry (8), the axis of LH LP port (41) is tilted 60° to the body axis of symmetry (8) and the axis (46) of a RH LP port (43) is tilted 60° to the body axis of symmetry (8).

The swivel turret (2) can be rotated left from its neutral position and locked with the turret positioning screw (45) screwed in one of the adjustment seats (45) of the body (1) every 30 degrees at one of the following three positions: the first intermediate left, the second intermediate left and the extreme left.

In the extreme left position of the swivel turret (2) the axis (46) of the central LP port (42) is tilted 90° to the body axis of symmetry (8), the axis of LH LP port (41) is tilted 150° to the body axis of symmetry (8) and the axis (46) of RH LP port (43) is tilted 30° to the body axis of symmetry (8).

The swivel turret (2) can be rotated right from its neutral position and locked with the turret positioning screw (45) screwed in one of the adjustment seats (49) of the body (1) every 30 degrees at one of the following three positions: the first intermediate right, the second intermediate right and the extreme right.

In the extreme right position of the swivel turret (2) the axis (46) of the central LP port (42) is tilted −90° to the body axis of symmetry (8), the axis of LH LP port (41) is tilted −150° to the body axis of symmetry (8) and the axis (46) of RH LP port (43) is tilted −30° to the body axis of symmetry (8).

The turret positioning screw (45) can be unscrewed from adjustment seats (49) of the body (1) thus enabling the turret (2) to be rotated freely during underwater diving and a selected LP port (41, 42, 43) of the swivel turret (2) can be oriented at any angle in a full 360° rotation around the turret axis of rotation (7).

In single cylinder configuration for recreational diving the pressure gauge hose (53) is connected to the HP port (31) of the body (1), while the LP hose of the inflator (54) is connected to the LP port (30) of the body (1). The swivel turret (2) is locked at its first left position, the LP hose of the primary second-stage regulator (55) is connected to its LH LP port (41), while the LP hose of the alternate second-stage regulator (56) is connected to the central LP port (42).

In side mount configuration with two independent dive cylinders, two first-stage regulators are used, a LH cylinder regulator and a RH cylinder regulator. To HP ports (31) of bodies (1) of both regulators, HP pressure gauge hoses (53) are connected respectively to the LH cylinder and the RH cylinder. The swivel turret (2) of the LH regulator is locked at its second right position, the LP inflator hose (54) is connected to its RH LP port (43), while the LP hose of the second-stage regulator (57) of the LH cylinder is connected to the central LP port (42). The swivel turret (2) of the LH regulator is locked at its second left position, the LP drysuit hose (59) is connected to its LH LP port (41), while the LP hose of the second-stage regulator (58) of the RH cylinder is connected to the central LP port (42).

In configuration with two cylinders (twinset) for technical diving, two first-stage diving regulators are used, a LH regulator and a RH regulator. The swivel turret (2) of the regulator is locked at its neutral position, the LP hose of the alternate second-stage regulator (56) is connected to its LH LP port (41), while the LP inflator hose (54) is connected to the central LP port (42). The HP pressure gauge hose (53) is connected to the HP port (31) of the RH regulator body (1). The swivel turret (2) of the RH regulator is locked at its neutral position, the LP hose of the primary second-stage regulator (55) is connected to its central LP port (42), while the LP drysuit hose (59) is connected to the RH LP port (43).

During diving with a stage bottle (decompression), the turret positioning screw (45) is unscrewed, so it is possible to change position of the swivel turret when diving at the start of decompression bottle use. The HP pressure gauge hose (53) is connected to the HP port (31) of the body (1). The LP hose of the second-stage regulator (60) can be connected to any LP port (41, 42, 43) of the swivel turret. If the stage bottle is unused, at its idle position, the LP hose of the second-stage diving regulator (60) is routed downwards and fixed to the bottle. If the stage bottle is used, the swivel turret (2) is rotated by the diver so that the LP hose of the second-stage diving regulator is routed towards his/her head.

The hose configurations and their connections to specified ports described above are typical and widely used, however it is obvious to one skilled in the art that other hose configurations and other combinations of connections to regulator ports are also possible.

The solutions described above allow the swivel turret (2) to be rotated freely in a full 360° or its rotation and locking LP ports (41, 42, 43) of the swivel turret (2) within 360°, i.e. from the extreme left position to the extreme right position, thus enabling proper HP hose configuration at any possible equipment configurations by using the same first-stage regulator.

LIST OF REFERENCE NUMERALS

1 Profiled body
2 Swivel turret
3 Cylinder connector sleeve
4 Cylinder connector knob
5 Cylinder connector screw
6 O-ring seal
7 Turret axis of rotation
8 Body axis
9 Cylinder connector axis
10 Anti-freezing membrane
11 Anti-freeze unit pusher
12 Spring adjustment screw
13 Spring retaining ring
14 Diaphragm
15 Anti-freeze unit pusher seat
16 Anti-freeze unit cover
17 Adjustment spring
18 Shim
19 Valve tie rod disk
20 Valve seat
21 O-ring seal
22 Valve poppet
23 Piston
24 Valve sealing sleeve guide
25 Closing spring
26 Valve sealing sleeve
27 Ring
28 Valve plug
29 O-ring seal
30 LP port of the body
31 HP port of the body
32 Axis of LP port of the body
33 Axis of HP port of the body
34 Profiling of LP port of the body
35 Profiling of HP port of the body
36 LP 3/8" port plug
37 HP 7/16" port plug
38 LP port plug o-ring seal
39 HP port plug o-ring seal
40 Swivel turret base
41 LH LP port of swivel turret
42 Central LP port of swivel turret
43 RH LP port of swivel turret
44 Turret positioning screw notches
45 Swivel turret positioning screw
46 Axis of LP port of the turret
47 Profiling of LP port of the turret
48 Axis of turret positioning screw notch
49 Body adjustment seat
50 Cone filter
51 O-ring seal
52 O-ring seal
53 HP pressure gauge hose
54 LP inflator hose
55 LP hose of the primary second-stage diving regulator
56 LP hose of the alternate second-stage diving regulator
57 LP hose of the second-stage regulator of LH cylinder (side mount)
58 LP hose of the second-stage regulator of RH cylinder (side mount)
59 LP drysuit hose
60 LP hose of the second-stage diving regulator (decompression)

What is claimed is:

1. A first-stage diving regulator comprising a profiled body (1) equipped with low pressure LP ports (30) and high pressure HP ports (31) arranged at an angle to an axis (8) of the body, where inside of the body along the axis (8) there is a set of valves and diaphragms, wherein the body is further equipped with an antifreeze unit and a cylindrical swivel turret (2) equipped with low pressure LP ports arranged at an angle to a turret axis of rotation (7) and to a cylinder connector equipped with a cylinder connector sleeve (3) with a cone filter (50), a cylinder connection knob (4) and a cylinder connection screw (5), the interconnection of which is sealed with O-rings (6), wherein an axis (9) of the cylinder connector is perpendicular to the body axis (8), the turret axis of rotation (7) and the axis (9) of cylinder connector laying in the same plane characterized in that the axis of rotation (7) of the swivel turret (2) is perpendicular to the body axis (8).

2. The first-stage diving regulator according to claim 1, wherein the swivel turret is equipped with at least one low pressure LP port, to which a low pressure LP hose is routed in any direction, around the axis of rotation (7) of the swivel turret (2).

3. The first-stage diving regulator according to claim 1, wherein the body is equipped with at least one adjustment seat (49), for a swivel turret positioning screw (45), and the swivel turret (2) has at least one notch (44), for the swivel turret positioning screw (45), locking the rotation of the swivel turret (2) at a set position.

4. The first-stage diving regulator according to claim 1, wherein the axis of the cylinder connector and the axis of turret rotation (7) are parallel to each other and lay in the same plane.

* * * * *